US007983576B2

(12) United States Patent
Bae

(10) Patent No.: US 7,983,576 B2
(45) Date of Patent: Jul. 19, 2011

(54) IMAGE FORMING APPARATUS HAVING FUNCTION TO CONTROL DEVELOPER EXHAUSTING AMOUNT AND IMAGE FORMING METHOD THEREOF

(75) Inventor: Byoung-chul Bae, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 676 days.

(21) Appl. No.: 11/962,580

(22) Filed: Dec. 21, 2007

(65) Prior Publication Data

US 2008/0181629 A1 Jul. 31, 2008

(30) Foreign Application Priority Data

Jan. 31, 2007 (KR) ..... 2007-10320

(51) Int. Cl.
*G03G 15/08* (2006.01)

(52) U.S. Cl. ..... 399/27; 399/53; 399/264; 399/360

(58) Field of Classification Search ..... 399/24–30, 399/38, 46, 49, 53, 252, 259, 264, 350, 358, 399/360

See application file for complete search history.

(56) References Cited

U.S. PATENT DOCUMENTS

| | | | | |
|---|---|---|---|---|
| 6,904,255 | B2 * | 6/2005 | Kera et al. | 399/299 |
| 2003/0053809 | A1 * | 3/2003 | Ogata et al. | 399/12 |
| 2006/0029405 | A1 * | 2/2006 | Tanaka et al. | 399/27 |

FOREIGN PATENT DOCUMENTS

| | | |
|---|---|---|
| JP | 2001-242766 | 9/2001 |
| KR | 2005-63095 | 6/2005 |
| KR | 2006-31972 | 4/2006 |
| KR | 2006-62922 | 6/2006 |

* cited by examiner

*Primary Examiner* — David P Porta
*Assistant Examiner* — Benjamin Schmitt
(74) *Attorney, Agent, or Firm* — Stanzione & Kim, LLP

(57) ABSTRACT

An image forming apparatus to form image data on a printing medium, the apparatus includes a developing cartridge having a developer transfer body to transfer developer to an image receptor, a developer storing unit to separately store a transfer-regulated developer which has been transfer-regulated in the developer transfer body and a non-transferred developer which is not transferred to the developer transfer body, and a used developer storing unit to store a used developer separated from a surface of the photoreceptor; a printing information storing unit to store cartridge printing information of the developing cartridge; and a controller to calculate an average printing density on a basis of the cartridge printing information, and to control the developing cartridge so that an amount in which the transfer-regulated developer of the developer storing unit is transferred to the used developer storing unit can exceed a reference amount if the calculated average printing density is below a reference printing density.

27 Claims, 7 Drawing Sheets

IMAGE FORMING APPARATUS HAVING FUNCTION TO CONTROL DEVELOPER EXHAUSTING AMOUNT AND IMAGE FORMING METHOD THEREOF

CROSS-REFERENCE TO RELATED APPLICATIONS

This application claims priority under 35 U.S.C. §119(a) from Korean Patent Application No. 10-2007-0010320, filed on Jan. 31, 2007 in the Korean Intellectual Property Office, the disclosure of which is incorporated herein in its entirety by reference.

BACKGROUND OF THE INVENTION

1. Field of the Invention

Apparatuses and methods consistent with the present general inventive concept relate to an image forming apparatus, and more particularly, to an image forming apparatus capable of controlling a developer exhausting amount according to an average printing density and an image forming method thereof.

2. Description of the Related Art

In general, an image forming apparatus forms image data stored in a host apparatus on a printing medium according to a printing signal. The image forming apparatus is provided with an image receptor in which an electrostatic latent image is formed, a developer transfer body that selectively spreads developer on the photoreceptor, and a transfer unit that transfers the developer developed on the photoreceptor to the printing medium to print a desired image on the printing medium. The image forming apparatus can be embodied by a printer, a photocopier, a scanner, and a multifunctional printer including these apparatuses.

The developing cartridge is detachably provided in the above-described image forming apparatus, and is provided as consumables that can be replaced if developer stored inside of the cartridge is exhausted.

As illustrated in FIG. 1, a conventional developing cartridge 10 comprises an electrifying part 12 which electrifies an image receptor 11 to a predetermined electric potential, the photoreceptor 11 which is electrified to a predetermined electric potential through the electrifying part 12 so that an electrostatic latent image is formed on its surface by an exposure of a light scanning unit (not illustrated), a developer transferring body 13 which is in contact with the photoreceptor 11 and spreads developer on the electrostatic latent image of the surface of the photoreceptor 11, a supplying part 15 which supplies the developer to the developer transferring body 13, a developer regulating member 14 which regulates an amount of the developer supplied to the developer transferring body 13, and a developer storing part 16 which stores developer.

Hereinafter, an operation of the conventional developing cartridge will be described. In a printing operation, a printing signal is received and the developer transferring body 13 supplied with developer from the supplying part 15 rotates, and maintains a developer layer having a uniform thickness by the developer regulating member 14. Also, the developer transferring body (or the developing roller) 13 rotates in a direction opposite to a rotation direction of the photoreceptor 11 and is in contact with the photoreceptor 11, and the developer supplied to the surface of the developer transferring body 13 is transferred to the electrostatic latent image of the photoreceptor 11 by a potential difference of the photoreceptor 11 to form a visible image on the photoreceptor 11. Also, the developer on the photoreceptor 11 is transferred to the printing medium by a transfer roller 20, and forms an image on a printing medium.

However, the conventional developing cartridge 10 repeatedly performs the above-described process regardless of an amount of the image data applied from a host apparatus (not illustrated). That is, even though the amount of the image data to which a printing signal has been applied is small, the above-described process is performed. Accordingly, if the amount of the image data is extremely small, the developer discharged from the developer storing part 16 by the supplying part 15 cannot be transmitted to the photoreceptor 11 and may rotatably remain in a peripheral area A proximate to the developer transferring body 13 and the supplying part 15.

Here, where the image data of the printing signal is extremely small, the discharged developer continues rotating in a peripheral area A proximate to the developer transfer part 13 and the supplying part 15 and comes to be under stress by contact with a frame or contact among particles of the developer. Also, if the developer is under stress, an internal additive and an external additive forming the developer may be separated from each other, or its shape may be deformed. Furthermore, if an image is formed on the printing medium by the deformed developer, a developing property and a fusing property deteriorate to thereby worsen print quality.

SUMMARY OF THE INVENTION

The present general inventive concept provides an image forming apparatus that can determine an average printing density of image data and can compulsorily exhaust the developer that has been under stress for a long time, and an image forming method thereof.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus to form image data on a printing medium, the apparatus including a developing cartridge having a developer transfer body to transfer developer to an image receptor, a developer storing unit to separately store a transfer-regulated developer which has been transfer-regulated in the developer transfer body and a non-transferred developer which is not transferred to the developer transfer body, and a used developer storing unit to store a used developer separated from a surface of the photoreceptor, a printing information storing unit to store cartridge printing information of the developing cartridge, and a controller to calculate an average printing density on a basis of the cartridge printing information, and to control the developing cartridge so that an amount in which the transfer-regulated developer of the developer storing unit is transferred to the used developer storing unit can exceed a reference amount if the calculated average printing density is below a reference printing density.

An electrifying unit which may be provided in the developing cartridge and may charge the photoreceptor to a predetermined electric potential, a supplying unit to supply the transfer-regulated developer of the developer storing unit to the developer transfer body and a high voltage power supplying unit to supply a voltage or a current to the electrifying unit and the developer transfer body, wherein the controller controls the high voltage power supplying unit to apply a predetermined reset power to at least one of the electrifying unit, the developer transfer body, and the supplying unit if the calculated average printing density is below the reference printing density.

The controller may classify the average printing density denoting a value of printed dots per page of a printing medium into a plurality of printing density sections having a predetermined range, and may set a time period to apply the reset power, respectively, according to each of the printing density sections having less than the reference printing density.

The controller may determine the printing density section to which the calculated average printing density belongs, and controls the high voltage power supplying unit to apply the reset power for a time period corresponding to the respective printing density section.

The reset power may be provided so that an absolute value of a reset voltage of the electrifying unit can be relatively low in comparison with an absolute value of an electrifying voltage or an electrifying current applied to the electrifying unit during forming an image.

The reset power may block the voltage or the current supplied to the electrifying unit.

The reset power may be provided so that the absolute value of a difference value between the developing voltage supplied to the developer transfer body and the supplying voltage or the supplying current supplied to the supplying unit can be larger than that during forming the image.

The image forming apparatus may further include a developer regulating unit which is provided on one side of the developer transfer body to regulate an amount of the transfer-regulated developer supplied from the supplying unit to the developer transfer body, wherein the reset power is provided so that an absolute value of a regulating voltage or a regulating current which the developer regulating unit applies to the transfer-regulated developer can be larger than that during forming the image.

The image forming apparatus may further include an exposure unit to scan light on the photoreceptor and to form an electrostatic latent image on a surface of the photoreceptor, wherein the reset power is provided so that an amount of the light scanned from the exposure unit can be larger than that during forming the image.

The image forming apparatus may further include a transfer unit which is provided to face the photoreceptor, to apply a transfer of a reference polarity voltage to the printing medium, and to transfer the transfer-regulated developer of the photoreceptor to the printing medium, wherein the controller controls the high voltage power supplying unit to apply a transfer voltage of opposite polarity to the reference polarity to the transfer unit while the reset power is being applied to the electrifying unit.

The image forming apparatus may further include a printing medium feeding unit to feed the printing medium between the developing cartridge and the transfer unit, wherein the controller controls the printing medium feeding unit to stop feeding the printing medium while the reset power is being applied to the electrifying unit.

The developing cartridge may further include a cleaning unit to separate remaining developer which has not been transferred to the printing medium from the surface of the photoreceptor, wherein the controller controls the cleaning unit to collect the developer on the surface of the photoreceptor in the used developer storing unit while the reset power is being applied.

The controller may control the high voltage power supplying unit not to apply the reset power if the calculated average printing density is below the reference printing density, and an amount of the remaining developer in the developer storing unit is less than a reference ratio of a maximum storing capacity of the developer storing unit.

The printing information storing unit may be provided on one side of the developing cartridge, and the average printing density of image data may be set by a ratio of a number of total printed dots with respect to a number of total printed sheets.

The average printing density of the image data may be set according to a reference period.

The average printing density of the image data may be set according to a reference number of sheets.

The image forming apparatus may further include a main body in which the developing cartridge is detachably provided and a main body printing information storing unit to store main body printing information of the main body, wherein the average printing density of image data is set by a ratio of a number of total printed dots with respect to a number of total printed sheets.

The foregoing and/or other aspects and utilities of the present general inventive concept can be achieved by providing an image forming method of an image forming apparatus to form image data on a printing medium and having a developing cartridge, the method including spreading developer on the printing medium and forming an image if a printing signal with respect to the image data is applied, calculating an average printing density and applying a reset power to the developing cartridge if the calculated average printing density is below a reference printing density.

The foregoing and/or other aspects and utilities of the general inventive concept may also be achieved by providing an image forming apparatus to form an image on a printing medium, the image forming apparatus comprising a main body, a developing cartridge attached to the main body, the developing cartridge having a developer storing unit to store developer and, a controller to determine an average printing density based on at least one of the developing cartridge and the main body, and to control removal of an amount of the developer from the developer storage unit not to be used to form the image corresponding to whether the determined average printing density is below a reference printing density.

The foregoing and/or other aspects and utilities of the general inventive concept may also be achieved by providing an image forming apparatus to form an image on a printing medium, the image forming apparatus comprising a developing cartridge having a developer storing unit to store developer, a photoreceptor to attract the developer and form the image on the printing medium, a cleaning unit to remove the attracted developer not used to form the image on the printing medium and a controller to determine whether to initiate a reset signal in response to a printing signal being received by the image forming apparatus, wherein the reset signal prevents the photoreceptor from forming the image on the printing medium and allows the cleaning unit to remove the attracted developer not used to form the image on the print medium.

The foregoing and/or other aspects and utilities of the general inventive concept may also be achieved by providing a method of operating an image forming apparatus to form an image on a printing medium, the method comprising storing developer in a developer storing unit, determining an average printing density based on at least one of the developing cartridge or the main body and controlling removal of an amount of the developer from the developer storing unit not to be used to form the image on the printing medium corresponding to whether the determined average printing density is below a reference printing density.

The foregoing and/or other aspects and utilities of the general inventive concept may also be achieved by providing method to prevent degraded images from being formed on a printing medium by an image forming apparatus, the method comprising storing developer in a developer storing unit, attracting the developer to a photoreceptor, determining whether to initiate a reset signal in response to receiving a printing signal, so that, if the determination is to initiate the reset signal, preventing the photoreceptor from forming an image on the printing medium and allowing the cleaning unit to remove the attracted developer not used to form an image on the printing medium from the photoreceptor; and if the determination is not to initiate the reset signal, forming the image by transferring the attracted developer from the photoreceptor to the printing medium.

The foregoing and/or other aspects and utilities of the general inventive concept may also be achieved by providing a computer-readable recording medium having embodied thereon a computer program to execute a method, wherein the method comprises storing developer in a developer storing unit, determining an average printing density based on at least one of the developing cartridge and the main body and controlling removal of an amount of the developer not to be used to form an image from the developer storing unit corresponding to whether the determined average printing density is below a reference printing density.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
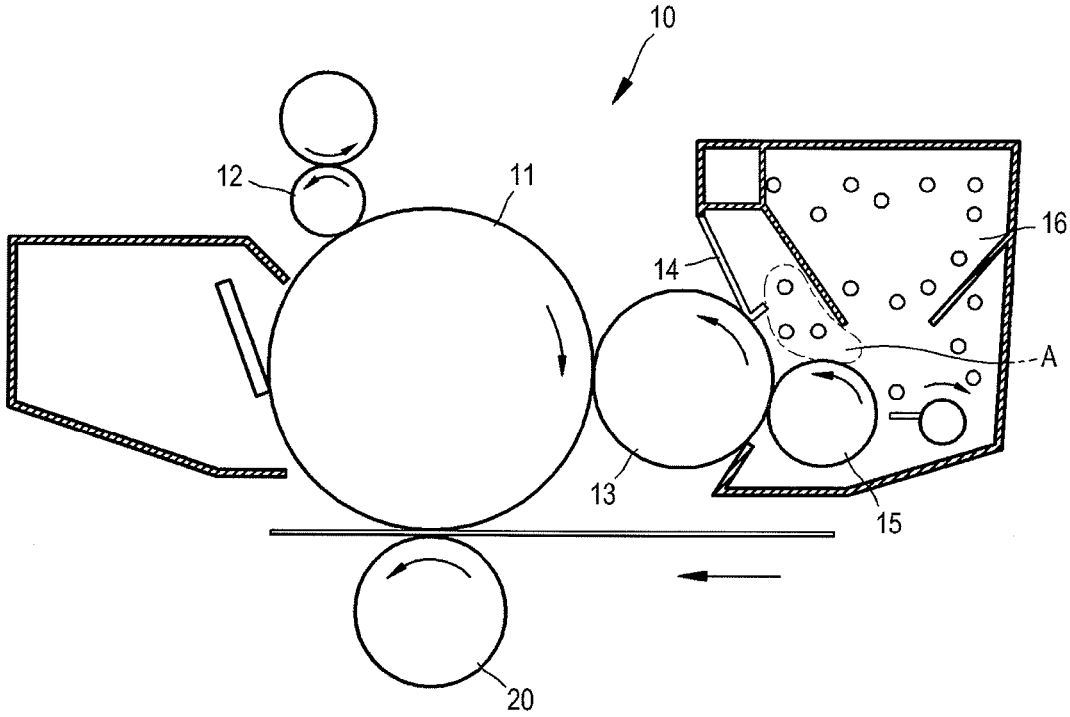
FIG. 1 (RELATED ART)
FIG. 1 a schematic view illustrating a configuration of a conventional developing cartridge.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 2:
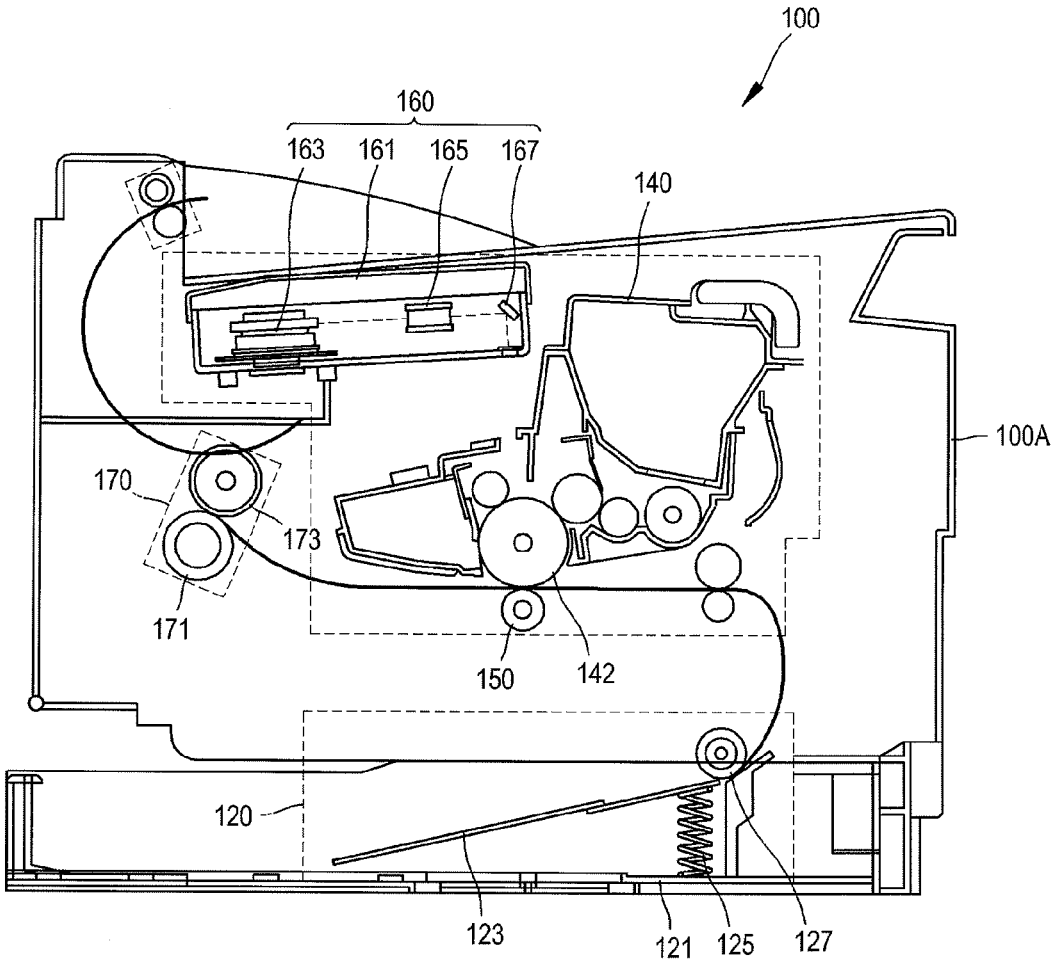
FIG. 2 is a schematic view illustrating a configuration of an image forming apparatus according to an embodiment of the present general inventive concept.
Figure 3:
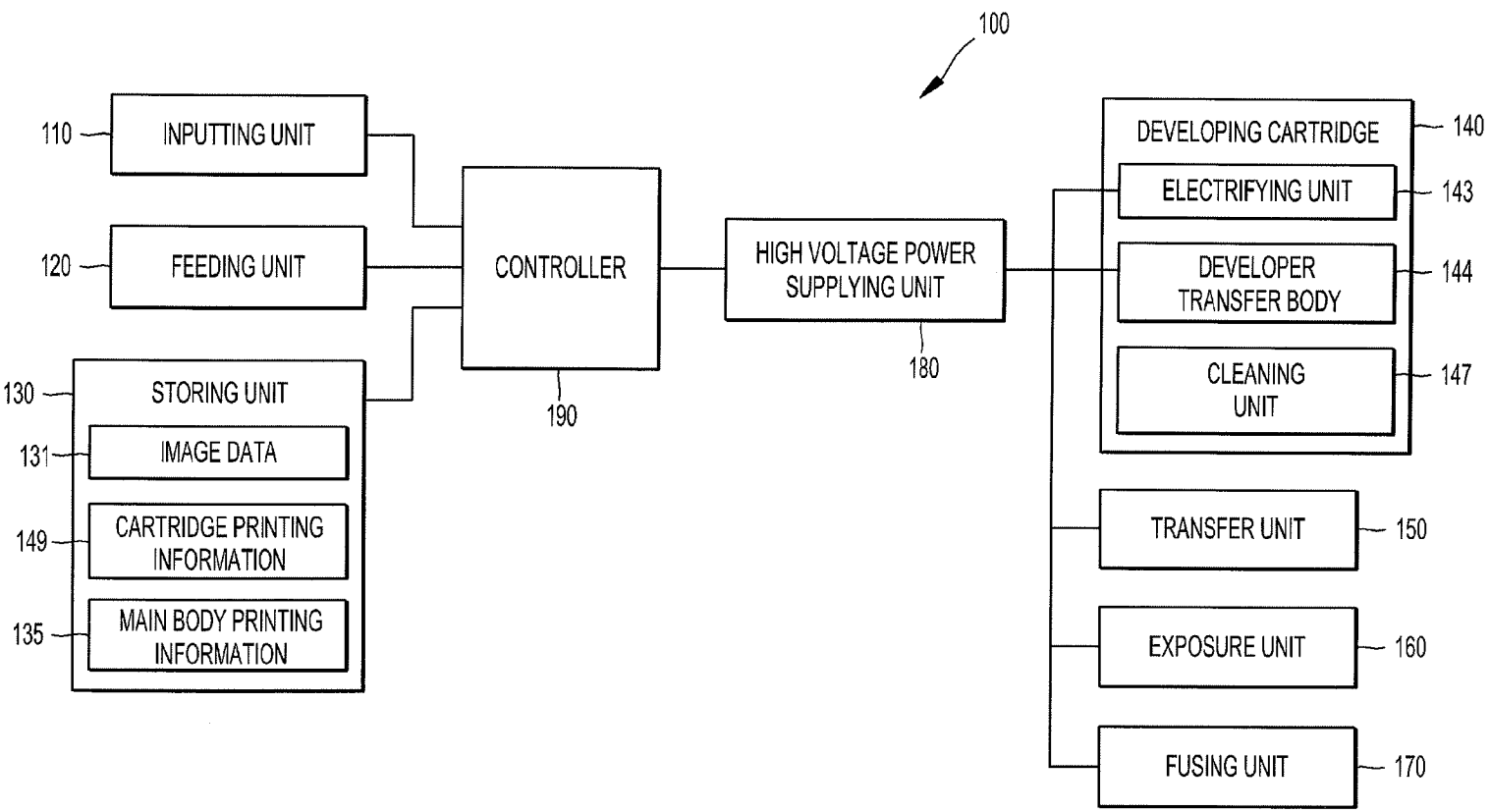
FIG. 3 is a block diagram illustrating a configuration of an image forming apparatus according to an embodiment of the present general inventive concept.

FIG. 2 is a schematic view illustrating a configuration of an image forming apparatus 100 according to an embodiment of the present general inventive concept, and FIG. 3 is a block diagram illustrating a configuration of an image forming apparatus 100 according to an embodiment of the present general inventive concept. As illustrated in FIGS. 2 and 3, the image forming apparatus 100 comprises an inputting unit 110 through which a printing signal is received, a feeding unit 120 to feed a printing medium, a storing unit 130 to store printing information, a developing cartridge 140 to store developer and to spread the developer to the printing medium, a transfer unit 150 to transfer the developer in the developing cartridge 140 to the printing medium, an exposure unit 160 to scan light onto an image receptor 142 of the developing cartridge 140 and to form an electrostatic latent image, a fusing unit 170 to fuse the developer on the printing medium by heat and pressure, a high voltage power supplying unit 180 to supply voltage to the developing cartridge 140 and the transfer unit 150, and a controller 190 to determine an average printing density through cartridge printing information and main body printing information and applies a reset power to the developing cartridge 140 and the transfer unit 150 so as to compulsorily exhaust the developer which has been under stress inside of the developing cartridge 140 for a long time period.

The inputting unit 110 receives the printing signal and informs the controller 190 of the printing signal. If the inputting unit 110 is connected with a host apparatus (not illustrated), the inputting unit 110 transmits a printing signal applied from the host apparatus (not illustrated), or transmits the printing signal applied through an inputting panel (not illustrated) provided in an outside surface of a main body 100A by a user. The inputting unit 110 may comprise an inputting panel which is provided with a character key and a number key so that the user can apply a variety of input signals, and a display panel which displays an operating condition of the main body 100A and image data to be printed.

The feeding unit 120 is detachably provided in the main body 100A and feeds a printing medium at a top of a pile thereon toward the developing cartridge 140 according to a control signal of the controller 190. As illustrated in FIG. 2, the feeding unit 120 comprises a cassette main body 121 which is detachably provided in the main body 100A, a knock-up plate 123 which is provided in the cassette main body 121 and stores a printing medium, a pick-up roller 127 which picks up the printing medium stored in the knock-up plate 123 to an outside of the knock-up plate 123, and an elastic member 125 which elastically biases the knock-up plate 123 toward the pick-up roller 127. Also, the feeding unit 120 may comprise at least a pair of transfer rollers (not illustrated) which transfer the printing medium picked up by the pick-up roller 127 according to a length and a shape of a feeding path, and a registration roller (not illustrated) which registers a leading edge of the printing medium.

Referring to FIGS. 2 and 3, in the storing unit 130 is stored image data and various types of data. The storing unit 130 comprises an image data storing unit 131 in which the image data is stored, a main body printing information storing unit 135 in which printing information of the main body is stored, and a cartridge printing information storing unit 149 which is provided in the developing cartridge and stores printing information of the developing cartridge 140. In the image data storing unit 131 may be stored image data applied with a printing signal from the host apparatus (not illustrated), or received fax data or scanned image data where a fax unit (not illustrated), or a scanning unit (not illustrated) are included.

In the main body printing information storing unit 135 is stored information, for example, that can correspond to the main body 100A having been shipped from a factory and possibly used. In the main body printing information storing unit 135 is stored information such as a number of total printed sheets, and a number of total printed dots that the main body 100A has printed, a production year and a number of use years of the main body 100A. The main body printing information storing unit 135 may be integrated with an image processing unit (not illustrated) or the controller 190.

Figure 4:
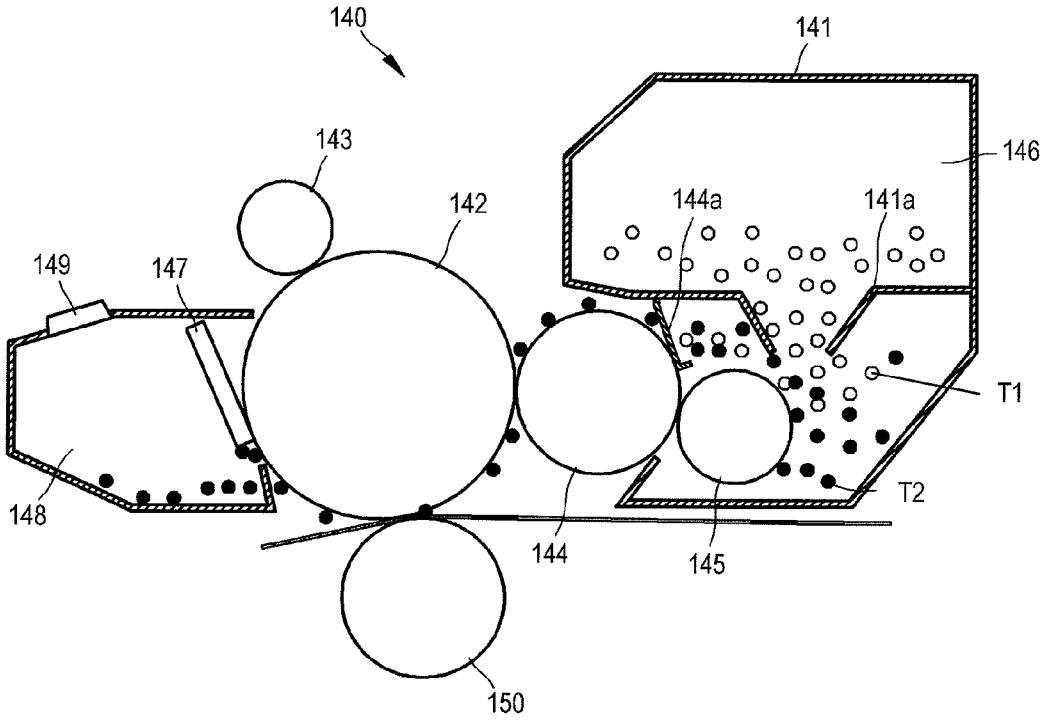
FIG. 4 is a schematic view illustrating a configuration of a developing cartridge according to an embodiment of the present general inventive concept.

As illustrated in FIG. 4, the developing cartridge 140 comprises a casing 141 which is detachably provided in the main body 100A, the image receptor 142 to spread developer to a printing medium, an electrifying unit 143 to electrify the photoreceptor 142 to a predetermined electric potential, a developer transfer body 144 to spread developer on the electrostatic latent image of the photoreceptor 142, a developer storing unit 146 to store developer, a supplying unit 145 to supply the developer in the developer storing unit 146 to the developer transfer body 144, a cleaning unit 147 to separate developer remaining on a surface of the photoreceptor 142 which is not transferred to the printing medium from the photoreceptor 142, a used developer storing unit 148 to store used developer separated from the photoreceptor 142, and a cartridge printing information storing unit 149 which is provided on one side of the casing 141 to store printing information of the developing cartridge 140.

The photoreceptor 142 spreads developer to the printing medium and forms an image thereon. The photoreceptor 142 may include a light conductive material layer formed by a method such as deposition on a circumference surface of a metal drum in a cylindrical shape. If the light conductive material layer is exposed by the exposure unit 160, the light conductive material layer responds to the light and an electrostatic latent image corresponding to the image data is formed.

The electrifying unit 143 electrifies the photoreceptor 142 to a uniform electric potential. The electrifying unit 143 rotates in contact with or out of contact with a circumference surface of the photoreceptor 142 and supplies an electric charge to enable the circumference surface of the photoreceptor 142 to have a uniform electric potential. The electrifying unit 143 is applied with an electrifying bias voltage by the high voltage power supplying unit 180. Also, the electrifying unit 143 is supplied with reset power by the high voltage power supplying unit 180 if the controller 190 determines an average printing density of the developing cartridge 140 or the main body 100A is below a reference printing density.

The electrifying unit 143 is classified into a corona type which has an electrifying wire and an electrifying shield provided to be out of contact with the photoreceptor 142 and electrifies the photoreceptor 142 to a predetermined electric potential by corona discharge of the electrifying wire, and a roller type which is rotated in contact with the photoreceptor 142 and electrifies the photoreceptor 142 to a predetermined electric potential.

The developer transfer body 144 supplies the developer supplied from the supplying unit 145 to the electrostatic latent image of the photoreceptor 142. The developer transfer body 144 is supplied with a developing voltage from the high voltage power supplying unit 180 so as to spread the developer on its surface to the photoreceptor 142. Here, the developing voltage is provided to be higher than a surface voltage that the surface of the photoreceptor 142 has by an electrifying voltage of the electrifying unit 143 and lower than a surface voltage of the electrostatic latent image exposed by the exposure unit 160. Accordingly, the developer on the surface of the developer transfer body 144 is provided and adheres to the electrostatic latent image of the photoreceptor 142 by the potential difference.

The developing voltage may be provided to be a high voltage in which an alternating voltage and a direct voltage are superimposed. However, the high voltage may be solely a direct voltage or an alternating voltage, as necessary.

Meanwhile, on one side of the developer transfer body 144 is provided a developer regulating member 144*a* to apply a tangential pressure to the developer transfer body 144 so that the developer supplied from the supplying unit 145 can be spread on the surface of the developer transfer body 144 in a uniform thickness. The developer regulating member 144*a* regulates the thickness of the developer layer spread on the developer transfer body 144 through a bending angle of an area in contact with the developer transfer body 144. Also, the developer regulating member 144*a* frictionally electrifies the developer, being in contact with the developer of the developer transfer body 144.

The supplying unit 145 rotates and supplies the developer in the developer storing unit 146 toward the developer transfer body 144 if the printing signal is applied. The supplying unit 145 is provided in a shape of a sponge, or a brush, and contacts the developer to generate static electricity and frictionally electrifies the developer. Meanwhile, the supplying unit 145 may be provided in plural according to a size and a shape of the developer storing unit 146.

The developer storing unit 146 stores developer. The developer storing unit 146 may comprise an agitator (not illustrated) which stirs the developer in its inside to supply the developer to the supplying unit 145. Also, the developer storing unit 146 may be provided with a partitioned wall 141*a* to prevent mixture of developer T2 which has been supplied toward the developer transfer body 144 to be under stress and developer T1 which is not supplied toward the supplying unit 145 not to be under stress.

Accordingly, the developer regulated from the developer transfer body 144 by the developer regulating member 144*a*, the developer T2 that has not been supplied toward the photoreceptor 142 to be under stress due to the small amount of the image data, and the developer T1 which has not been under stress can be prevented from being mixed each other.

The cleaning unit 147 cleans used developer remaining on the surface of the photoreceptor 142 after the developer on the surface of the photoreceptor 142 is transferred to the printing medium by a transfer voltage of the transfer unit 150. The used developer cleaned by the cleaning unit 147 is stored in the used developer storing unit 148. Also, the cleaning unit 147 separates the developer T2 which has been under stress, not transferred to the printing medium and adhered to the surface of the photoreceptor 142 from the surface of the photoreceptor 142 to store the same in the used developer storing unit 148 if a reset power is applied to the electrifying unit 143 and the transfer unit 150 by the controller 190.

The cleaning unit 147 may generally employ a blade type in which the cleaning unit 147 contacts the photoreceptor 142 and cleans the used developer on the surface of the photoreceptor 142, and a brush type in which the cleaning unit 147 cleans the used developer by friction with the photoreceptor 142.

Meanwhile, on one side of the photoreceptor 142 may be further provided a charge eraser (not illustrated) to keep the electric potential on the surface of the photoreceptor 142 uniform after the cleaning unit 147 completes a cleaning operation. The charge eraser is generally provided as a static-electricity cleaning lamp.

The cartridge printing information storing unit 149 is provided on one side of the casing 141 and stores printing information of the developing cartridge 140. The cartridge printing information stored in the cartridge printing information storing unit 149 includes a year, a month, and a date of production of the developing cartridge 140, and a period of use, a number of total printed sheets, a number of total printed dots, an amount of used developer, and an amount of the developer remaining in the developer storing unit 146 since the developing cartridge 140 has been manufactured and mounted to the main body 100A. The cartridge printing information storing unit 149 may be provided as a radio frequency identification (RFID) tag to transmit and receive information to/from the controller 190 through a radio frequency, a smart chip to store information, and an erasable and programmable-read only memory (EP-ROM) to electrically store information.

Referring to FIG. 2, the transfer unit 150 is provided to face the photoreceptor 142 and to apply a predetermined transfer voltage to a rear surface of the printing medium to transfer the developer on the surface of the photoreceptor 142 to the printing medium. The transfer unit 150 determines a thickness and a resistance characteristic of the printing medium and is supplied with an optimum transfer voltage from the high voltage power supplying unit 180 (FIG. 3) to apply the same to a rear side of the printing medium. In general, the transfer unit 150 applies a transfer voltage of a polarity opposite to the polarity of the developer to enable the developer on the surface of the photoreceptor 142 to be transferred to the printing medium. Accordingly, the transfer unit 150 is supplied with a higher voltage than the voltage of an exposed area of the photoreceptor 142 from the high voltage power supplying unit 180.

The exposure unit 160 comprises a light source unit (not illustrated) that generates a light source, a polygon mirror 163, a reflection mirror 167, plural optical holes 165, and a casing 161 to support each of these components. The light source unit (not illustrated) comprises a light source that generates and scans light and a regulating lens (not illustrated) that regulates the scanned light to be parallel with an optical axis. The polygon mirror 163 is provided with plural reflection surfaces to scan the light generated from the light source unit (not illustrated) toward a sub-scanning direction. The light source (not illustrated) may be provided as a plurality of laser diodes.

The fusing unit 170 fuses the developer transferred from the photoreceptor 142 to the printing medium by heat and pressure. The fusing unit 170 comprises a heating roller 171 that applies heat to the printing medium, and a pressing roller 173 that rotates to face the heating roller 171 and applies pressure to the printing medium.

Referring to FIGS. 3 and 4, the high voltage power supplying unit 180 supplies a voltage or a current to the electrifying unit 143, the developer transfer body 144, the transfer unit 150, and the exposure unit 160 according to a control signal of the controller 190. The high voltage power supplying unit 180 applies a direct voltage, an alternating voltage, or a superimposed voltage of the direct voltage and the alternating voltage to each of the components by control of the controller 190 in printing the image data, and applying the reset power.

The controller 190 controls the above-described components to form an image corresponding to the image data on the printing medium if the printing signal is applied with respect to the image data. Also, the controller 190 calculates an average printing density of the developing cartridge 140 or an average printing density of the main body 100A on a basis of the cartridge printing information or the main body printing information after the image forming is completed. Also, where each of the calculated average printing density is below a reference printing density, the controller 190 increases the transfer amount of the developer T2 so as to compulsorily transfer the developer T2 that has been under stress and is remaining inside the developing cartridge 140 to the used developing storing unit 148. Accordingly, the controller 190 controls the high voltage power supplying unit 180 to apply the reset power to at least one of the electrifying unit 143, the developer transfer body 144, a developer regulating member 144*a*, and the transfer unit 150.

That is, the controller 190 determines that there is a lot of developer having been under stress inside the developing cartridge 140 if the calculated average printing density is below the reference density, and compulsorily transfers the developer which has been under stress to the used developer storing unit 148 so as to prevent the printing quality from being deteriorating by the stressed developer.

Here, the average printing density can be obtained by a ratio of a number of total printed dots with respect to a number of total printed sheets. The average printing density of the main body 100A can be calculated from the number of the total printed sheets and the number of the total printed dots printed in the main body 100A on a basis of the main body printing information stored in the main body printing information storing unit 135. Also, the average printing density of the developing cartridge 140 can be calculated on the basis of the number of the total printed sheets and the number of the total printed dots printed in the developing cartridge 140.

The controller 190 classifies the average printing density (a number of dots per page) into plural sections having a maximum and a minimum, and establishes a time period to apply the reset power if the average printing density is below the reference density. For example, if it is classified into five sections, section 1 denotes that the average printing density is over 5%, section 2 denotes that the average printing density is over 2%, section 3 denotes that the average printing density is over 1%, section 4 denotes that the average printing density is over 0.5%, and section 5 denotes that the average printing density is over 0.2%.

Furthermore, the controller 190 can establish a time period to apply the reset power with respect to the sections 4 and 5, respectively, where the section 3 has been decided to be the reference printing density. Here, the lower the calculated average printing density is, the longer the time period to apply the reset power may be set. That is because there is a lot of developer to be consumed since it is determined that the amount of the developer T2 which has been under stress and remains inside the developing cartridge 140 is abundant as the reference density is low.

Meanwhile, the controller 190 can determine whether the reset power will be applied on the basis of the average printing density of the main body 100A, or on the basis of the average printing density of the developing cartridge 140. Also, the controller 190 may determine whether the reset power will be applied by reflecting the average printing density of the main body 100A and the average printing density of the developing cartridge 140 at the same time.

Here, the reset power denotes a voltage value/a current value that can transfer the developer that has been under stress to the used developer storing unit 148 in the amount exceeding the reference amount.

The reset power, according to an exemplary embodiment of the present general inventive concept, denotes a value that enables an absolute value of the electrifying voltage applied to the electrifying unit 143 to be lower in comparison with an absolute value of the electrifying voltage applied to the electrifying unit 143 during forming an image. That is, the reset power denotes a voltage value to be the same state as the state where the photoreceptor 142 is electrified by the electrifying unit 143 and the entire area is exposed by the exposure unit 160 while an image is formed.

Figure 7:
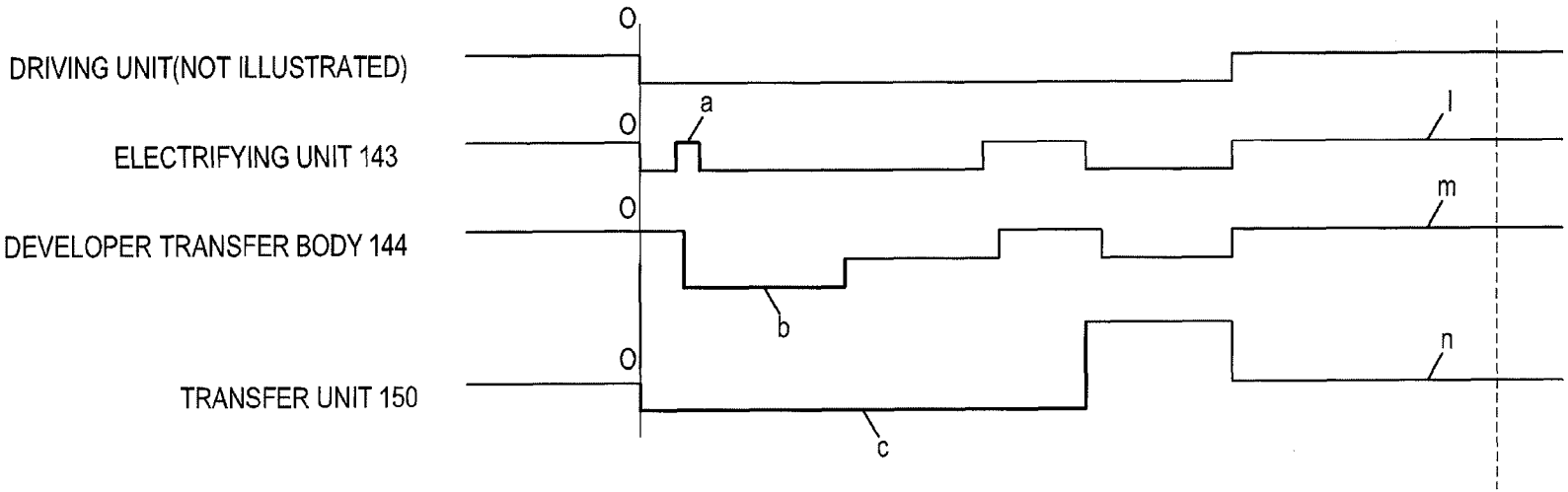
FIG. 7 is an exemplary view illustrating a reset power value of each of the configuration units according to the present general inventive concept.

Accordingly, the controller 190 can control the high voltage power supplying unit 180 to supply a particular voltage value to the electrifying unit 143, or can control the power of the high voltage power supplying unit 180 supplied to the electrifying unit 143 to be blocked. Accordingly, as illustrated in FIG. 7, the electrifying unit 143 which has had a negative value (−) during forming the image has a voltage approximate to 0 (an area a). Accordingly, the photoreceptor 142 in contact with the electrifying unit 143 has a voltage of −100~0V. As illustrated in FIG. 7, the value denotes a higher value than the developing voltage value b of the developer transfer body 144, and accordingly, the amount of developer T2 which has been under stress on the surface of the developer transfer body 144 may be transferred to the photoreceptor 142.

Meanwhile, the reset power according to another exemplary embodiment of the present general inventive concept is provided so that an absolute value of a difference between the developing voltage supplied to the developer transfer body 144 and the supplying voltage value supplied to the supplying unit 145 can be larger than in forming the image. For example, if the developing voltage of the developer transfer body 144 is −300V and the supplying voltage is −500V in forming the image, the absolute value of the difference between the two voltages is 200. Accordingly, if the reset power is applied, the developing voltage of the developer transfer body 144 denotes −300V, and the supplying voltage of the supplying unit 145 denotes −600V, an absolute value of the difference between the two voltages is 300. Since the potential difference between the developing transfer body 144 and the supplying unit 145 is large if the absolute value of the voltage difference is large, the amount of the developer T2 that has been under stress and supplied from the supplying unit 145 to the developer transfer body 144 increases. Accordingly, the consumption of the developer T2 that has been under stress increases for the same time.

Meanwhile, the reset power according to another exemplary embodiment applies a higher voltage to the developer regulating member 144*a* in comparison with an absolute value of a voltage applied thereto in forming the image. That is, because the amount of the developer T2 which has been under stress, is not regulated by the developer regulating member 144*a* and is transferred to the photoreceptor 142 increases where the higher voltage is applied to the developer regulating member 144*a* in comparison with the voltage applied in forming the image.

Also, a thickness of the developer layer regulated by the developer regulating member 144*a* may be increased by extending a contact angle between the developer regulating member 144*a* and the developer transfer body 144. Accordingly, the contact angle between the developer regulating member 144*a* and the developer transfer body 144 may increase when applying a reset power by providing a position of a supporting member (not illustrated) to support the developer regulating member 144*a* in the casing 141 to be changeable.

In addition, the reset power according to another exemplary embodiment may be provided to regulate the amount of the light output from the exposure unit 160 to the photoreceptor 142. The reset power can increase the power of the light source supplied from the high voltage power supplying unit 180 to the exposure unit 160 to increase the amount of the light generated in the light source of the exposure unit 160. That is, if the output amount of each of the laser diodes forming the light source increases, the absolute value of the surface voltage of the electrostatic latent image in an exposed area of the surface of the photoreceptor 142 becomes lower than that during forming the image, so that the transfer amount of the developer T2 that has been under stress and is transferred from the developer transfer body 144 to the photoreceptor 142 can be increased.

Meanwhile, the controller 190 controls the voltage value/the current value applied to the developer transfer body 144 so that the transfer amount of the developer T2 that has been under stress and is transferred to the photoreceptor 142 can increase for when the reset power is applied in the developing cartridge 140 as the above-described exemplary embodiments.

Also, the controller 190 controls the high voltage power supplying unit 180 to apply a transfer voltage having a polarity opposite to the transfer voltage having been applied during forming of the image to the transfer unit 150. In general, the transfer unit 150 applies a high positive voltage value so that the developer having a negative voltage value can be transferred from the surface of the photoreceptor 142 to the printing medium. However, since the developer T2 that has been under stress is not allowed to be transferred to the printing medium when the reset power is applied, as illustrated in FIG. 7, the high voltage power supplying unit 180 supplies a negative voltage (an area c) lower than the voltage value of the developer to the transfer unit 150.

Accordingly, the developer T2 having been under stress on the surface of the photoreceptor 142 is not transferred to the printing medium by the transfer unit 150, but cleaned by the cleaning unit 147 to be collected in the used developer storing unit 148.

Meanwhile, as described above, the controller 190 calculates the average printing density on the basis of the number of the total printed sheets and the total printed dots during the entire use period of the main body 100A and the developing cartridge 140, or on the basis of a reference period or a reference number of printed sheets. That is, the controller 190 determines whether the reset power will be applied by calculating the average printing density with respect to the latest 100 printed sheets, or by calculating the average printing density for a latest week. That's because the user's pattern of the printing density is not uniformly maintained, but may be suddenly changed.

Also, the controller 190 can determine at predetermined intervals whether the reset power will be applied. That is, whether the reset power will be applied can be determined by presetting a cycle such as once a week, or once a day. The printing quality can be uniformly maintained when there are a lot of total printed sheets, but a small deal of printed data. Here, the cycle to determine whether the reset power will be applied may be set as a default value in the controller 190 or may be set by the user.

Meanwhile, even where the controller 190 determines the average printing density of the main body 100A or the developing cartridge 140 to be smaller than a reference printing density, the controller 190 can control the reset power not to be applied if the controller 190 determines the amount of the developer remaining in the developing cartridge 140 to be less than the reference ratio of the remaining developer with respect to an accommodating capacity of the developer storing unit 146. That is, the controller 190 can control the reset power not to be applied if the amount of the remaining developer is less than 20% of the total storing capacity of the developer storing unit 146 even though the average printing density belongs to the above-described section 5. That's because it is not practical to exhaust the developer having been under stress by applying the reset power since the remaining lifetime of the developer is short if there is little developer remaining inside the developer storing unit 146.

Figure 5:
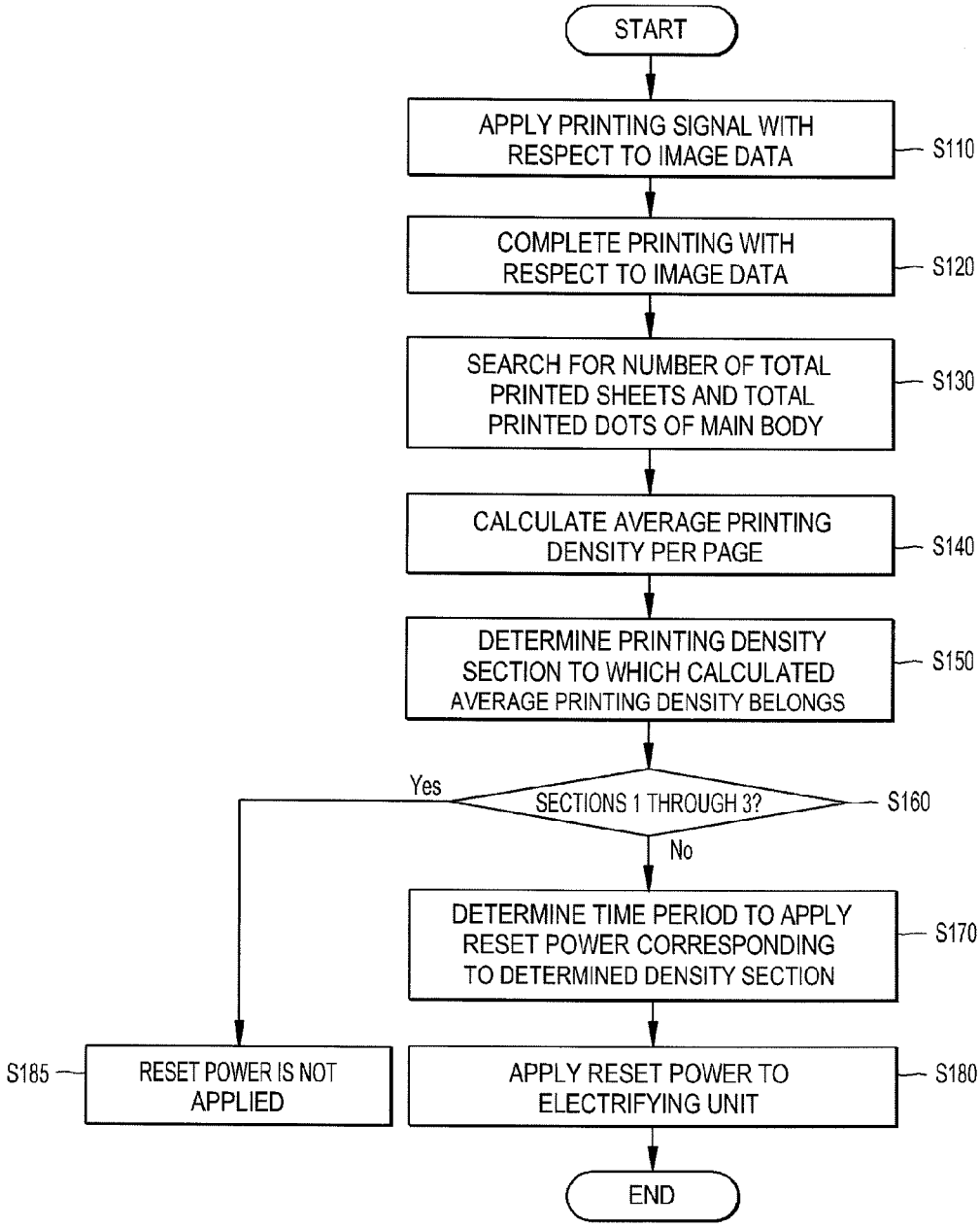
FIG. 5 is a flow diagram illustrating an image forming method to apply a reset power according to a first exemplary embodiment of the present general inventive concept.

An exemplary embodiment of an image forming method of the image forming apparatus 100 with this configuration according to the present general inventive concept will be described by referring to FIG. 5.

First, if a printing signal with respect to image data is applied from a host apparatus (not illustrated) at operation S110, the controller 190 controls the developing cartridge 140, the transfer unit 150 and the exposure unit 160 to complete a printing operation with respect to the image data. Accordingly, the charge removing unit (not illustrated) of the photoreceptor 142 keeps the electric potential on the surface of the photoreceptor 142 uniform, and the electrifying unit 143 applies a predetermined electrifying voltage.

For convenience's sake, it will be described as an example that the high voltage power supplying unit 180 applies an electrifying voltage of −1,200V to the electrifying unit 143, applies a direct voltage of −400V and an alternating voltage of a range of a predetermined voltage to the developer transfer body 144, and applies a transfer voltage of +2,000V to the transfer unit 150.

If the electrifying unit 143 applies the electrifying voltage of −1,200V, the surface of the photoreceptor 142 is uniformly electrified to a value of −600V. If the light is scanned from the exposure unit 160, the electrostatic latent image of the photoreceptor 142 has a value of −50V. At this time, the developer on the developer transfer body 144 to which the developing voltage of −400V is applied is spread onto the electrostatic latent image of the photoreceptor 142 having a higher voltage value in comparison with the developer transfer body 144.

Also, the developer on the surface of the photoreceptor 142 is transferred to the printing medium by the transfer voltage of the +2,000V applied from a rear surface of the printing medium, and fused onto the printing medium by heat and pressure applied from the fusing unit 170.

Meanwhile, if the image formation with respect to the image data is completed at operation S120, the number of the total printed sheets and the number of the total printed dots of the main body 100A are obtained from the main body information storing unit 135 at operation S130, and the average printing density with respect to the image data is calculated (operation S140). Also, the printing density section to which the calculated average printing density belongs is determined at operation S150, and it is determined whether the determined printing density section exceeds the reference density section. Here, if the reference density section is the section 3, it is determined whether the determined printing density section belongs to the sections 1 through 3 (operation S160).

If the determined printing density section belongs to the sections 1 through 3, the controller 190 comes to an end without applying the reset power (operation S185). Alternatively, if the printing density section does not belong to the sections 1 through 3, the controller 190 controls the high voltage power supplying unit 180 to apply the reset power for a time period preset to correspond to the respective section.

Accordingly, as illustrated in FIG. 7, the high voltage power supplying unit 180 blocks the supply of the voltage to the electrifying unit 143 for a predetermined time period and applies the voltage of −1,000V of a polarity opposite to the reference voltage in forming the image to the transfer unit 150. An entire area of a predetermined portion of the photoreceptor 142 is electrified to a voltage of −50~0V by the blocking of the voltage supplied to the electrifying unit 143, and the developer T2 having been under stress and lying on the surface of the developer transfer body 144 having a relatively low voltage value is developed to the photoreceptor 142.

The controller 190 stops a feeding operation of the feeding unit 120 to stop transferring the printing medium. Meanwhile, since the transfer unit 150 applies the same polar transfer voltage as the developer, the developer on the surface of the photoreceptor 142 is not transferred to the transfer unit 150 and rotates while adhering to the surface of the photoreceptor 142 to be separated from the surface of the photoreceptor 142 by the cleaning unit 147.

Here, the longer the time period to block the transfer voltage of the electrifying unit 143 is, the more a consumption amount of the developer T2 having been under stress increases.

Figure 6:
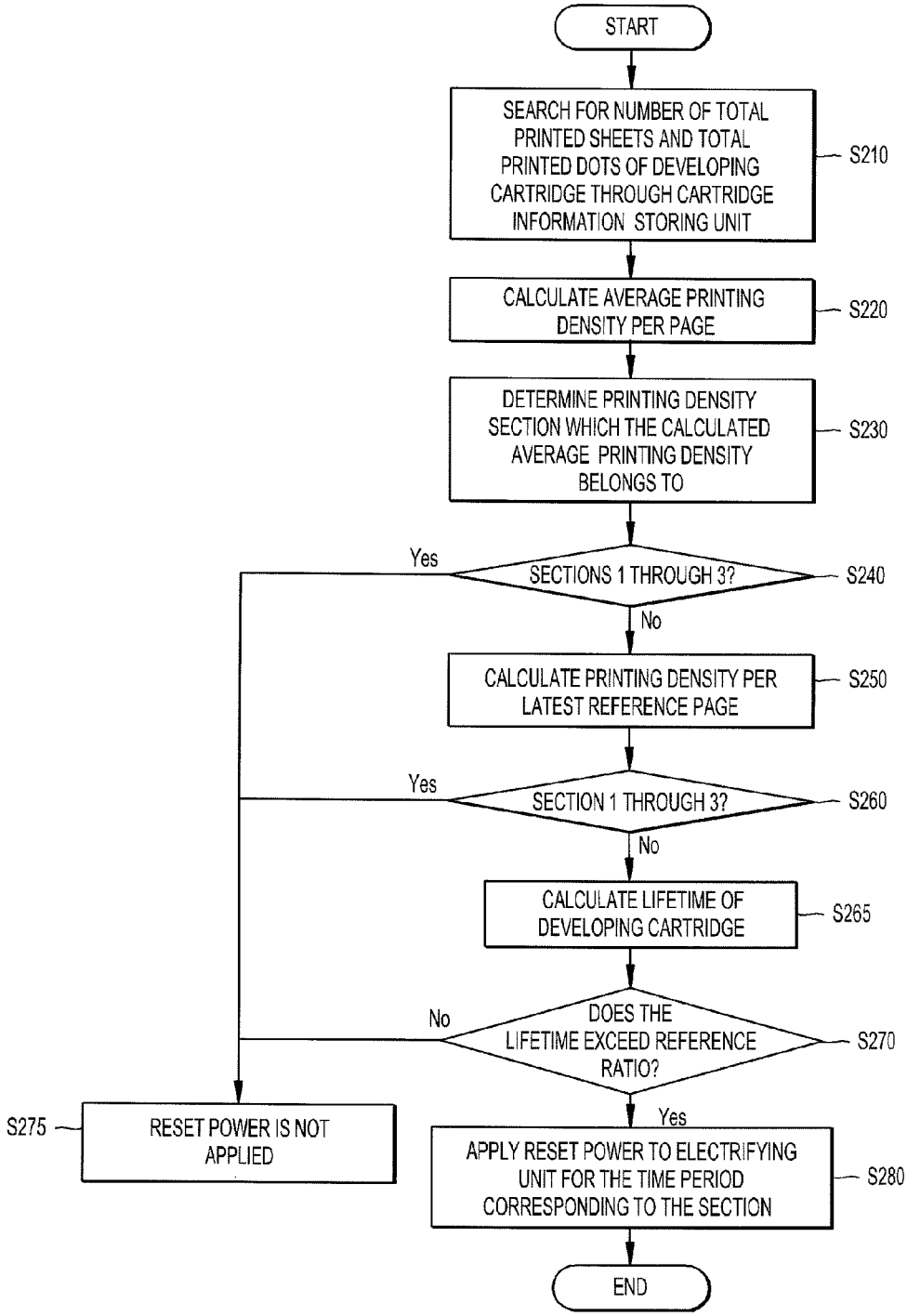
FIG. 6 is a flow diagram illustrating an image forming method to apply a reset power according to a second exemplary embodiment of the present general inventive concept.

Meanwhile, FIG. 6 is a flow diagram illustrating the image forming method of the image forming apparatus 100 according to another exemplary embodiment.

First, the controller 190 searches for the number of the total printed sheets and the total printed dots of the developing cartridge 140 through the cartridge printing information stored in the cartridge information storing unit 149 (operation S210). The average printing density per page is calculated on the basis of the searched result at operation S220, and the printing density section to which the calculated average printing density belongs is determined (operation S230).

It is determined whether the determined printing density section belongs to the sections 1 through 3 exceeding the reference printing density. If it is determined that the printing density section belongs to the sections 1 through 3, the reset power is not applied (operation S275). However, if it is determined that the printing density section does not belong to the sections 1 through 3, an average printing density per latest reference page is calculated (operation S250). That is, the average printing density with respect to the latest 100 pages or the reference pages is calculated. It is determined whether the average printing density per latest reference page belongs to the sections 1 through 3 at operation S260, and the reset power is not applied at operation S275 where it belongs to the sections 1 through 3.

Meanwhile, if the average printing density does not belong to the sections 1 through 3, the amount of the developer remaining in the developing cartridge 140 is calculated to determine the lifetime of the developing cartridge 140 at operation S265. If the amount of the remaining developer is less than the reference ratio, for example, less than 20% of the amount of the total stored developer, as the result of the calculation, the reset power is not applied (operation S275). However, if the average printing density does not belong to the sections 1 through 3, and the amount of the remaining developer is exceeding the reference ratio, the reset power is applied to the electrifying unit 143 for a time period corresponding to the section to which the average printing density belongs. The description of a process to apply the reset power will be omitted, as it is the same as described above.

In the above-described exemplary embodiment, it has been supposed that the reset power blocks the power to the electrifying unit 143, but the same process can be also performed where the other exemplary embodiments of the reset power are applied, respectively, or are applied in combination with each other.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, the average printing density of the developing cartridge or the main body is determined and the transfer amount of the developer having been under stress for a long time is compulsorily increased, thereby maintaining the printing quality uniform according to various embodiments of the present general inventive concept.

Also, the average printing density is calculated in various ways to extend the scope of the control, as necessary.

Meanwhile, the above-described image forming apparatus according to the exemplary embodiment of the present general inventive concept has been described as a monochrome type forming a black image, but it may be applied to a color type having a plurality of developing cartridges such as yellow, magenta, cyan, and black.

As described above, the image forming apparatus according to various embodiments can increase a transferred amount of developer deformed by stress to the used developer storing unit on a basis of an average printing density of the developing cartridge or the main body, thereby maintaining a printing quality uniform.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus to form an image on a printing medium, the image forming apparatus comprising:

a main body;

a developing cartridge attached to the main body, the developing cartridge having a developer storing unit to store developer; and a controller to determine an average printing density based on at least one of the developing cartridge and the main body, to classify the average printing density into a plurality of printing density sections having a predetermined range, to set a time period to apply a reset power, and to control removal of an amount of the developer from the developer storing unit corresponding to whether the determined average printing density of at least one of the plurality of the printing density sections is below a reference printing density by applying the reset power during the set time period.

2. The image forming apparatus according to claim 1, further comprising:

an electrifying unit which is provided in the developing cartridge to charge a photoreceptor to a predetermined electric potential;

a supplying unit to supply the developer of the developer storing unit to a developer transfer body; and a high voltage power supplying unit to supply a voltage or a current to the electrifying unit and the developer transfer body, wherein the controller controls the high voltage power supplying unit to apply the reset power to at least one of the electrifying unit, the developer transfer body, and the supplying unit if the determined average printing density is below the reference printing density.

3. The image forming apparatus according to claim 2, wherein the controller determines the printing density section to which the calculated average printing density belongs, and controls the high voltage power supplying unit to apply the reset power for a time period corresponding to the respective printing density section.

4. The image forming apparatus according to claim 2, wherein the reset power is provided so that an absolute value of a reset voltage of the electrifying unit is less than an absolute value of an electrifying voltage or an electrifying current applied to the electrifying unit during forming an image.

5. The image forming apparatus according to claim 4, wherein the reset power blocks the voltage or the current supplied to the electrifying unit.

6. The image forming apparatus according to claim 2, wherein the reset power is provided so that the absolute value of a difference value between the developing voltage supplied to the developer transfer body and the supplying voltage or the supplying current supplied to the supplying unit can be larger than that during forming the image.

7. The image forming apparatus according to claim 2, further comprising:

a developer regulating unit which is provided on one side of the developer transfer body to regulate an amount of the developer supplied from the supplying unit to the developer transfer body, wherein the reset power is provided so that an absolute value of a regulating voltage or a regulating current which the developer regulating unit applies to the developer can be larger than that during forming the image.

8. An image forming apparatus according to claim 2, further comprising:

an exposure unit to scan light on the photoreceptor and to form an electrostatic latent image on a surface of the photoreceptor, wherein the reset power is provided so that an amount of the light scanned from the exposure unit can be larger than that during forming the image.

9. The image forming apparatus according to claim 2, further comprising:

a transfer unit which is provided to face the photoreceptor, to apply a transfer of a reference polarity voltage to the printing medium, and to transfer the developer of the photoreceptor to the printing medium, wherein the controller controls the high voltage power supplying unit to apply a transfer voltage of opposite polarity to the reference polarity to the transfer unit while the reset power is being applied to the electrifying unit.

10. The image forming apparatus according to claim 9, further comprising:

a printing medium feeding unit to feed the printing medium between the developing cartridge and the transfer unit, wherein the controller controls the printing medium feeding unit to stop feeding the printing medium while the reset power is being applied to the electrifying unit.

11. The image forming apparatus according to claim 2, wherein the developing cartridge further comprises:

a cleaning unit to separate remaining developer which has not been transferred to the printing medium from a surface of the photoreceptor, wherein the controller controls the cleaning unit to collect the developer on the surface of the photoreceptor in a used developer storing unit while the reset power is being applied.

12. The image forming apparatus according to claim 2, wherein:

the controller controls the high voltage power supplying unit not to apply the reset power if the determined average printing density is below the reference printing density; and an amount of the remaining developer in the developer storing unit is less than a reference ratio of a maximum storing capacity of the developer storing unit.

13. The image forming apparatus according to claim 2, further comprising:

a main body in which the developing cartridge is detachably provided; and a main body printing information storing unit to store main body printing information of the main body, wherein the average printing density of image data is set by a ratio of a number of total printed dots with respect to a number of total printed sheets of the main body.

14. The image forming apparatus according to claim 1, wherein:

a printing information storing unit is provided on one side of the developing cartridge; and the average printing density of image data is set by a ratio of a number of total printed dots with respect to a number of total printed sheets.

15. The image forming apparatus according to claim 14, wherein the average printing density of the image data is set according to a reference period.

16. The image forming apparatus according to claim 15, wherein the average printing density of the image data is set according to a reference number of sheets.

17. The image forming apparatus of claim 1, wherein the average printing density is determined based on a ratio of a number of total printed dots with respect to a number of total printed sheets corresponding to at least one of the developing cartridge and the main body.

18. The image forming apparatus of claim 1, wherein the developer storing unit comprises:

a plurality of chambers formed by one or more partitioning walls.

19. An image forming apparatus to form an image on a printing medium, the image forming apparatus comprising:

a developing cartridge having a developer storing unit to store developer;

a photoreceptor to attract the developer and form the image on the printing medium;

a cleaning unit to remove the attracted developer not used to form the image on the printing medium; and a controller to determine whether to initiate a reset signal that blocks at least one of a voltage and a current supplied to an electrifying unit of the developing cartridge in response to a printing signal being received by the image forming apparatus, wherein the reset signal prevents the photoreceptor from forming the image on the printing medium and allows the cleaning unit to remove the attracted developer not used to form the image on the print medium.

20. The image forming apparatus of claim 19, wherein the controller determines an average printing density based on at least one of the developing cartridge and the main body.

21. The image forming apparatus of claim 20, wherein the controller determines whether to initiate the reset signal in response to the printing signal being received corresponding to whether the determined average printing density is below a reference printing density.

22. A method of operating an image forming apparatus to form an image on a printing medium, the method comprising:

storing developer in a developer storing unit;

determining an average printing density based on at least one of the developing cartridge or the main body;

classifying the determined average printing density into a plurality of printing density sections having a predetermined range; and controlling removal of an amount of the developer not to be used to form the image on the printing medium from the developer storing unit corresponding to whether the determined average printing density of at least one of the plurality of the printing density sections is below a reference printing density.

23. A method to prevent degraded images from being formed on a printing medium by an image forming apparatus, the method comprising:

storing developer in a developer storing unit;

attracting the developer to a photoreceptor;

determining whether to initiate a reset signal that blocks at least one of a voltage and a current supplied to an electrifying unit of the developing cartridge in response to receiving a printing signal, so that:

if the determination is to initiate the reset signal, preventing the photoreceptor from forming an image on the printing medium and allowing a cleaning unit to remove the attracted developer not used to form an image on the printing medium from the photoreceptor; and if the determination is not to initiate the reset signal, forming the image by transferring the attracted developer from the photoreceptor to the printing medium.

24. A method of operating an image forming apparatus, the method comprising:

determining an average printing density on a printing medium with a controller of the image forming apparatus;

classifying the average printing density with the controller into a plurality of sections having at least a maximum and a minimum; and determining a time period to apply a reset power signal to the image forming apparatus when the classified average printing density is less than a reference density.

25. The method of claim 24, further comprising:

exhausting developer from a developing cartridge mounted in the image forming apparatus when the reset power signal is applied.

26. An image forming apparatus to form an image on a printing medium, the image forming apparatus comprising:

an image forming unit to form the image on the printing medium; and a controller to determine an average printing density on the printing medium, to classify the average printing density into a plurality of sections having at least a maximum and a minimum, and to determine a time period to apply a reset power signal to the image forming apparatus when the classified average printing density is less than a reference density.

27. The image forming apparatus of claim 26, wherein the controller controls an exhausting of developer from a developing cartridge mounted in the image forming apparatus when the reset power signal is applied.

* * * * *